United States Patent [19]

Schwörer

[11] 4,316,594

[45] Feb. 23, 1982

[54] FORMWORK PANEL FOR CONCRETE WALLS

[75] Inventor: Artur Schwörer, Senden, Fed. Rep. of Germany

[73] Assignee: Peri-Werk Artur-Schworer KG, Weissenhorn, Fed. Rep. of Germany

[21] Appl. No.: 125,270

[22] Filed: Feb. 27, 1980

[30] Foreign Application Priority Data

Mar. 3, 1979 [DE] Fed. Rep. of Germany ..... 2908284

[51] Int. Cl.[3] ..... E04G 11/00

[52] U.S. Cl. ..... 249/18; 249/38; 249/43; 249/45; 249/192

[58] Field of Search ..... 249/18, 38, 40, 43, 249/45, 213, 189, 192, 112, 207

[56] References Cited

U.S. PATENT DOCUMENTS

| | | | |
|---|---|---|---|
| 1,467,903 | 9/1923 | McCallum | 249/38 |
| 1,907,618 | 5/1933 | Umbach et al. | 249/43 |
| 2,305,252 | 12/1942 | Hayden | 249/213 |
| 3,465,999 | 9/1969 | Gates | 249/213 |
| 3,648,961 | 3/1972 | Farrow | 249/43 |
| 3,918,673 | 11/1975 | Abbott | 249/43 |
| 3,941,346 | 3/1976 | Franc | 249/40 |
| 4,027,847 | 6/1977 | Johnson | 249/40 |

*Primary Examiner*—Donald E. Czaja
*Assistant Examiner*—W. Thompson

[57] ABSTRACT

A formwork panel for constructing concrete walls having a forming skin supported by a steel frame in which a plurality of holes are provided for receiving a tie rod. The holes are provided with a plastic bushing which extends through and is fastened in the frame. The bushing has a conically tapered bore, the surface of which is continuous and smooth. This makes the removal of concrete from the bore extremely easy (FIG. 3).

17 Claims, 7 Drawing Figures

Fig. 1
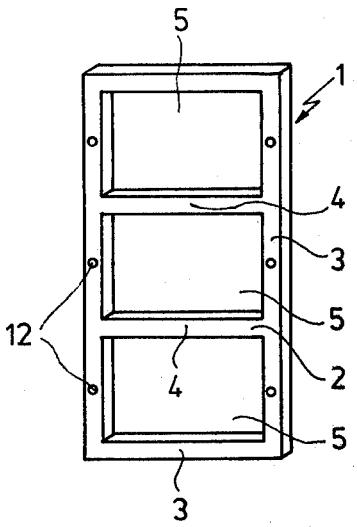
Fig. 2
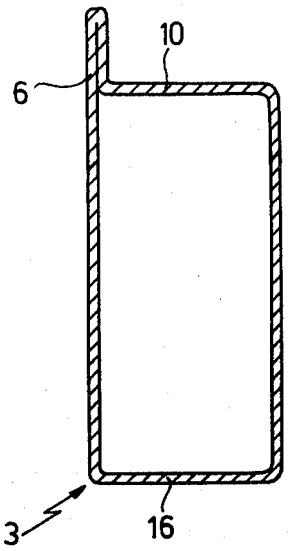
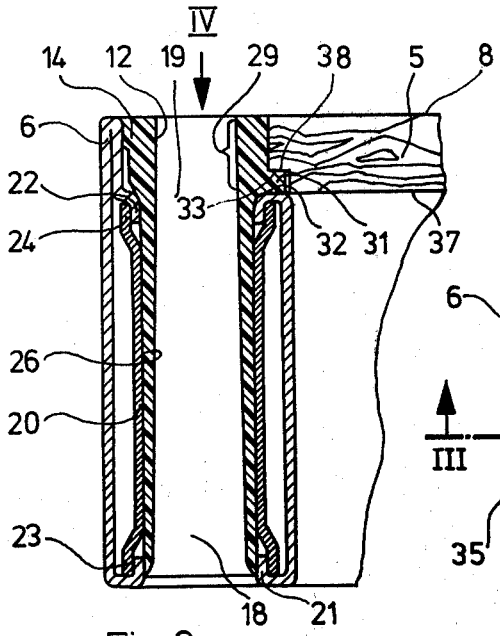
Fig. 3
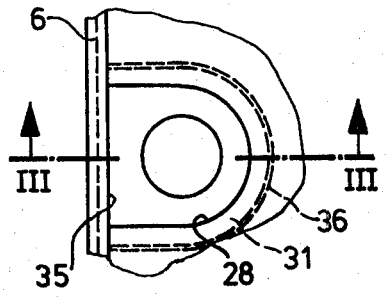
Fig. 4

FORMWORK PANEL FOR CONCRETE WALLS

BACKGROUND OF THE INVENTION

The invention relates to a formwork panel for concrete walls comprising a forming skin supported by a steel frame in which a bore extending through the steel frame and arranged in a bushing is provided for receiving a tie rod extending through the wall. In known formwork panels the steel frames consist of rectangular hollow sections arranged along the edges of the forming skin which generally takes the form of a plywood panel. The forming skin is further supported by medium struts and cross-struts. Along the edges of the formwork panel there are provided openings for receiving the tie rods. As a rule, these openings take the form of bores extending through the forming skin, the wall of the hollow section supporting the forming skin and also the opposite wall of the hollow section. The openings into which no tie rod is inserted must be covered with a plastic cap or the like before the concrete is poured to prevent the concrete from entering these bores and hardening therein. Experience shows, however, that the openings not used for the insertion of tie rods remain uncovered for numerous reasons, either because the caps are not readily at hand, or else for other reasons.

Then, when the formwork panels are re-used, it will first be necessary in many cases, before the tie rods can be inserted, to remove the hardened concrete from the openings with the aid of a concrete drill. This is not only a troublesome and time-consuming work, but also a handicap which seriously disturbs the assembly operation. It has already been known to make the openings through the steel frame and the forming skin a little larger and to weld a bushing into the opening which will prevent the concrete from penetrating into the hollow interior of the rectangular section of the frame. However, the removal of the concrete plug hardened in this steel bushing is by no means facilitated by this arrangement, but rather rendered more difficult because of the adhesion of the hardened concrete plug to the inner wall of the steel bushing.

Now, it is the object of the present invention to facilitate the removal of any concrete that may have penetrated into bores of this type and hardened therein.

According to the present invention, this problem is solved by a bore of conical shape provided in a bushing made of a plastic material extending through and fastened in the frame.

The conical shape of the bore and the fact that the bushing is no longer made of steel, as in the known arrangements, but of a plastic material, reduces the adhesion of the hardened concrete in the bore so that the concrete plug can be easily pushed out of the bore from the end of the bore having the smaller diameter. A hammer and if necessary a rod may be used, it is no longer necessary to use a drilling machine for the cleaning of such tie rod bores. The material used for the manufacture of the plastic bushing should have an impact resistance high enough to prevent damages to the bushing as a result of the removal of the concrete plug. Moreover, the slightly conical bore of the plastic bushing should have a smooth interior surface, but this is a feature anyway exhibited by most of the existing plastic materials. Although the term "bore" is used in this specification in connection with the plastic bushing, it does not mean that the slightly conical central opening in the bushing is produced by drilling. Rather, these bushings are produced in the usual manner by die-casting or the like.

The material of which the plastic bushings are made may preferably consist of a polyamide, but of course any suitably adjusted PVC may also be used.

In one embodiment of the invention, the plastic bushing comprises a mounting flange engaging a projection of the forming skin from behind. The projection is preferably formed by a recess in the side of the forming skin facing the frame, and the flange is fixed between the forming skin and the frame over at least a portion of its periphery. This offers the advantage that the plastic bushings can be fastened in the forming skin by very simple means, i.e. by inserting it into a bore in the frame of a corresponding size before mounting the forming skin on the steel frame, so that after the assembly of the forming skin, which generally consists of a plywood panel, to the frame the flange of the plastic bushing is clamped between the forming skin and the frame and, thus, retained in position. To this end, the flange need not necessarily engage a recess in the side of the forming skin facing the frame. Rather, the plastic bushing can be fixed also by causing the flange to engage either a slot in the forming skin extending in parallel to its plane, or else a recess in the face of the forming skin facing the concrete. In this latter case, the bushing must be fastened to the forming skin by nails or the like applied through the flange. The flange serving to fix the plastic bushing in position need not necessarily engage the forming panel about the whole periphery of the plastic bushing. Rather, the bushing will be sufficiently fastened also when the flange is engaged by a projection of the forming skin only about a portion of its periphery.

In another embodiment of the invention, the conical bore of the plastic bushing has its larger diameter at the end of the bore opposite the forming skin. The main advantage of this arrangement lies in the fact that any concrete entering the open end of the bore situated in the forming plane will encounter an increasing cross-section as it penetrates into the bore and apply only little pressure upon the inner faces of the plastic bushing so that, as a result, there is only little risk that the angle of taper of the bore may be disturbed at some point by an expansion of the plastic bushing. As the taper of the bore remains unchanged even in cases of extended use of the formwork panel, the hardened concrete plug will always be in loose contact only with the bore so that it can always, even in the case of extended use of the panel, be easily removed, if necessary with one single blow of the hammer. In addition, this embodiment offers the following advantage: Tie rods are as a rule inserted only after one side of the formwork of the concrete wall has been erected and when the opposite formwork is being assembled. In this case, the worker works on the inner side of the formwork first erected. If in such a case he wishes to remove a concrete plug from a bore in a formwork panel first erected, it is a definite advantage if this can be done by him without changing his position, i.e. from the inner face of the formwork first errected. Another advantage of this embodiment lies in the fact that the spacer sleeve applied on the tie rod covers the smaller hole.

In order to give the plastic bushing increased strength and to safely prevent, for instance any expansion of its bore in the course of time, the plastic bushing may be embedded in a supporting bushing made from metal, preferably iron or steel. In one embodiment of the invention, this supporting bushing surrounds only the portion of the plastic bushing situated in the steel frame, whereas in other embodiments the supporting bushing may surround also the portion of the plastic bushing situated in the forming skin, in addition to that situated in the frame.

In one embodiment of the invention, the supporting bushing surrounds only the portion of the plastic bushing situated within the hollow section. In this case, the supporting bushing is retained by beading over the edges of the bores in the walls of the hollow section. As compared to this arrangement, the metal bushings inserted in known formwork panels into the bores of the steel frames are retained therein be welding seams or welding spots. This arrangement offers the disadvantages that the larger bore weakens the section in the area of these welds, that deformations are caused by the welding operation and that welding is more expensive.

The above-mentioned embodiment of the invention may be further improved by an arrangement in which the diameter of the supporting sleeve is enlarged at the sleeve ends and in which the beaded edges of the bores provided in the walls of the frame fit into the space between the enlarged ends of the supporting bushing and the outer face of the plastic bushing.

In this arrangement, the enlargement preferably corresponds to the thickness of the beaded edges so that the plastic bushing is also guided at this end. Or else the interior diameter of the supporting bushing can be left unchanged whereas the outer diameter of the plastic bushing is sufficiently reduced in the area of the ends of the supporting bushing so that a clearance is obtained between the inner wall of the supporting bushing and the outer wall of the plastic bushing for receiving the beaded-over edges of the bores.

In known formwork panels, the bore in the steel frame is continued, with the same diameter, in the forming skin mounted on the frame. This proved disadvantageous because only a thin web of the forming skin, which consists of a plywood panel, remains between the outer edge of the forming skin and the section of the bore nearest to the edge, which web tends to break after repeated use of the formwork panel. In one embodiment of the invention, the opening intended for receiving the tie rod, which must be in alignment with the bores in the frame, is no longer drilled, but produced by means of a milling cutter which is applied to the edge of the forming skin and advanced inwardly until the axis of the milling cutter coincides with the axis of the bore in the frame. Accordingly, the opening receiving the tie rod comprises two straight lateral faces extending inwardly from the edge and ending in a semicylindrical surface which is in alignment with the bore in the frame. According to the invention, the end of the plastic bushing which is flush with the forming plane is provided with a head matching the shape of such an opening produced with the aid of a milling cutter. The advantage of this arrangement lies in the fact that any breaking of the forming skin at its edge adjacent to the bore is prevented and that the forming skin exhibits an even surface in the forming plane also at this point.

The invention may be realized also by an arrangement in which a formwork panel has inserted into openings in the steel frame metal bushings for receiving the tie rods which have the inner wall of their bore lined with a plastic layer so that essentially the same advantages are obtained as in the case of the embodiment of the invention in which the plastic bushing takes the form of a separate part. The bore in the metal bushing increases slightly conically towards the end of the bushing opposite the forming skin, and the plastic layer is of essentially constant thickness over the length of the bore. The bore of the metal bushing may also be of cylindrical shape and have pressed into it a plastic bushing having a conical bore, the outer face of the plastic bushing being provided with a torus engaging an annular groove provided at the inner face of the metal bushing.

BRIEF DESCRIPTION OF THE DRAWINGS

The embodiments of the invention will be described in detail with reference to the drawings in which:

FIG. 1 is a rear plan view of one embodiment of the formwork panel of the invention;

FIG. 2 is a sectional view along line II—II showing the hollow section of the frame of the panel and without the form skin;

FIG. 3 is an enlarged view of a longitudinal section through the bore along line III—III in FIG. 4;

FIG. 4 is an enlarged plan view of the bore, viewed in the direction indicated by the arrow IV—IV in FIG. 3;

DESCRIPTION OF INVENTION

Figure 5:
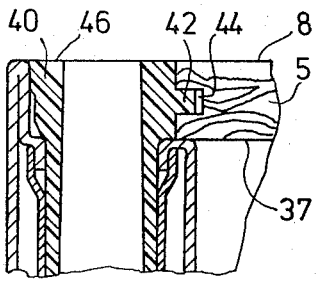
FIG. 5 is a sectional view similar to that shown in FIG. 3, partly broken away, showing another embodiment of the invention.

FIG. 1 shows the side of the formwork panel 1 opposite the forming plane. The forming panel 1 is constructed of a frame 2 formed by hollow tubular members 3 having a cross-section shown in FIG. 2 and two cross-struts 4 formed by a simple rectangular hollow tubular member. The frame supports a single-piece forming skin 5 at equal distances from the two narrow sides of the panel 1. All hollow sections are made of steel.

The forming skin 5 is conventionally made of a plywood panel of 2 cm thickness and is set within a peripheral projection 6 formed on the hollow members 3 as is apparent from FIG. 2. The projection 6 also has a height of 2 cm so that the end face of the forming skin is protected on all sides by the projection 6, without the latter extending beyond the plane of the facing surface 8 of the forming skin 5. Rear support of the forming skin 5 is provided by the front wall portion 10 of the hollow member 3. The forming skin 5, the wall portion 10, and its opposite wall portion 16 are provided with a plurality of aligned openings, generally depicted by the numeral 12, for the insertion of conventional tie rods.

FIGS. 3 and 4 show the design of the formwork panel in the area of the openings 12 which serve as passage openings for tie rods. Each of the openings 12 is provided with a plastic bushing 14 having a conically shaped bore, the narrowest diameter lying in the area of the facing surface 8.

The openings 18 and 19 in the rear and front walls 10 and 16 respectively are formed by perforating the frame member 3. After opening up each of the openings 18 and 19 the edges 21 and 22 obtained by such perforation are rolled inward and, a supporting sleeve 20 of steel is inserted into the interior of the hollow member 3.

Thereafter these edges 21 and 22, respectively, are beaded about the ends 23 and 24 of the supporting sleeve 20, to come to rest against the inner face of the supporting sleeve. The ends 23 and 24 are expanded in relation to the general diameter of the supporting sleeve. The amount of expansion is such that the inner faces of the beaded-over portion of the edges 21 and 22 are flush with the inner face 26 of the supporting sleeve 20 in its unexpanded area so that the bushing 14 is supported along its length. In the area between the beaded-over edge 21 and the beaded-over edge 22, the outside of the plastic bushing is cylindrical, the outer diameter of the plastic bushing being such that it comes to rest against the supporting sleeve and also against the beaded-over edges 21 and 22. As can be seen in the drawing, the outer—in FIG. 3, lower—end of the plastic bushing is also supported, namely by the beaded-over edge 21. Thus, the edges 21 and 22 of the openings 18 and 19 engage the space between the supporting bushing and the plastic bushing 14 in the area of the ends 23 and 24 of the supporting bushing 20.

The plastic bushing 14 is longer than the distance between the front wall 10 of the hollow member and the rear wall 16. Its upper end—as viewed in FIG. 3—is exactly flush with the plane of the forming surface 8. The forming skin 5 is provided in the area of the plastic bushing 14 with a milled recess 28 which is open towards the edge of the forming skin 5. The end portion 29 of the plastic bushing 14 arranged in the area of the forming skin 5 has a cross-section matching the milled recess 28, at least in the area of the forming surface 8. At a certain distance from the forming surface, the plastic bushing is provided with an outwardly projecting flange 31. The bottom 32 of the flange rests upon the front wall 10 of the hollow members while the top side 33 of the flange 31 supports a shoulder 38 of the forming skin 5 formed by milling a recess 36 into the rear face 37 of the forming skin. As can be seen in FIG. 4, the flange 31 is missing only where a straight side 35 of the plastic bushing 14 is in direct contact with the projection 6 of the hollow member 3 which otherwise serves to protect the end face of the forming skin 5. The flange 31 which is fixed between the shoulder 33 of the forming skin 5 and the front wall 10 of the hollow section provides an undetachable connection of the plastic bushing 14 to the formwork panel 1, while permitting at the same time its easy exchange, if required.

Advantageously, the conical shape of the bore in the plastic bushing 14 should extend over the whole length or at least over a considerable part of the length of the plastic bushing, and the opening should have only a slight outward taper, which means that the angle of taper of the opening should not be excessively great. For instance, the conical opening may have a length of 12 cm, its outer diameter may be 24 mm and its inner diameter, which is flush with the forming plane, may be 20 mm. The plastic bushing 14 consists of a suitable polyamide. The openings 18 and 19 in the two walls 10 and 16 of the hollow member 3 are of identical size.

The arrangement shown in FIG. 5 differs from that shown in FIG. 3 only in that the bushing 40 is provided with a flange-like projection 42 which instead of the flange 31 is midway between the facing surface and the wall 10, and that the said flange-like projection 42 engages a groove 44 in the forming skin 5. The groove 44 prevents the bushing 40 from moving vertically to the forming surface plane 8 and makes it easier to bring the frontal face 46 of the bushing 40 in safe alignment with the forming surface 8, by simple means.

Figure 6:
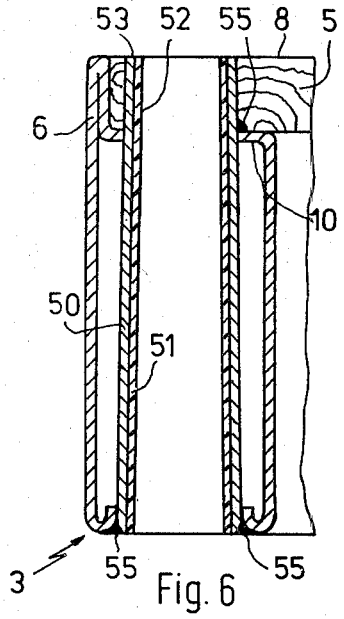
FIG. 6 is a longitudinal sectional view similar to that shown in FIG. 3 showing a third embodiment of the invention.

In the embodiment shown in FIG. 6, the frame 3 has welded into it a metal sleeve 50 the bore of which is slightly tapered to open towards the end opposite the forming skin 5. The metal sleeve 50 is lined with a plastic layer 51 of essentially uniform thickness. Thus, the inner wall 52 of the plastic layer 51 is likewise slightly tapered. The end 53 of the metal sleeve 50 facing the forming skin 5 is flush with the forming surface 8, and the forming skin 5 is provided with an opening into which projects the portion of the metal sleeve 50 which extends beyond the section 10 of the hollow section 3. FIG. 6 shows a few welding spots 55 which serve to retain the metal sleeve 50 in the hollow section 3. The connection between the plastic layer 51 and the metal sleeve 50 is extremely firm so that the plastic layer 51 and the metal bushing 50 will not come apart when a concrete plug, which anyway adheres only loosely to the inner wall 52, is pushed out.

Figure 7:
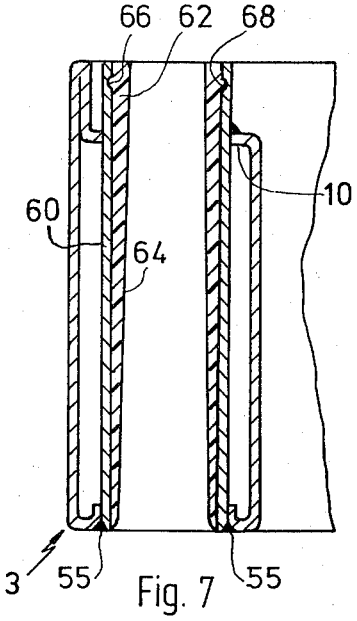
FIG. 7 is a longitudinal sectional view similar to that shown in FIG. 6 showing a fourth embodiment of the invention.

In the embodiment shown in FIG. 7, a circular metal sleeve 60 with the same cross-section throughout is welded into the hollow frame 3. Here again, the metal sleeve 60 extends beyond the front wall 10 right into the forming plane of the forming skin which is not shown in this drawing.

Fastened in the cylindrical bore of the metal, sleeve 60 is a plastic bushing 62 having an essentially cylindrical outer wall and a tapered bore 64 which opens towards its end opposite the forming skin. The plastic bushing 62 is held in the metal sleeve 60 by an annular groove 66 arranged in the inner wall of the metal sleeve 60 in the area of its end facing the forming skin, which groove is engaged by an annular projection 68 on the plastic bushing 62, as can be seen in FIG. 7. The plastic bushing 62 may be produced as a separate part and inserted into the metal sleeve 60. During this latter operation, the plastic bushing 62 is slightly distorted in the area of its end facing the forming skin so that the projection 68 and the groove 66 form a snap connection. But the plastic bushing 62 may also be produced within the bore of the metal bushing 60, for instance by die-casting. In this case, the tapering bore 64 is formed by a suitable mould core.

What we claim is:

1. A form for concrete construction, comprising a sheet like panel having a front face and a rear face mounted on a supporting frame, said form having a plurality of openings extending through the panel and frame perpendicularly to the front face, a bushing secured within at least one of said openings, said bushings comprising a unitary tubular plastic member having a conically tapered inner bore, the surface of which is continuous and substantially smooth, said bushing having a length corresponding substantially to the thickness of said form and having one end lying substantially in the plane of the front face of said panel.

2. The form according to claim 1 wherein said frame is formed with a flange extending perpendicularly to the front face of said panel, said flange being continuous about the periphery of said frame to surround the edges of said panel and having a depth substantially equal to the thickness of said panel.

3. The form according to claim 1 or 2, wherein the opening in said panel is formed by a recess extending inwardly from the edge thereof and said tubular plastic member is provided with an enlarged portion filling said recess.

4. The form according to claim 1 or 2, wherein said plastic member is provided with a mounting flange and said panel is provided with a cooperating projection for engaging said flange to secure said bushing.

5. The form according to claim 1 or 2, wherein said panel is formed with a recess on the rear surface providing said projection and the flange of said plastic member is fixed within said recess between said panel and said frame.

6. The form according to claim 1 or 2, wherein said tubular plastic member is provided with a projection and the edge of said panel is provided with a groove, said projection and groove lying a predetermined distance below the front face of said panel and cooperating to secure said bushing.

7. The form according to claim 1, wherein the larger diameter of said conical bore is at the end of the tubular plastic member opposite the panel.

8. The form according to claim 1 including a supporting sleeve surrounding said tubular plastic member.

9. The form according to claim 8, wherein the frame is provided with openings formed with inwardly directed beads and said supporting sleeve is secured within the frame by said beads.

10. The form according to claim 9, wherein the ends of said supporting sleeve secured by said beads is diametrically enlarged and that said beaded ends extend between the enlarged ends of said sleeve and said tubular plastic member.

11. A form for concrete construction comprising a sheet like panel having a front face and a rear face mounted on a supporting frame, said form having a plurality of openings extending through the panel and frame perpendicularly to the front face, a bushing located in at least one of said openings, said bushing comprising a metallic sleeve having a conically tapering inner bore provided with a uniform layer of plastic material, one end of said bushing lying in the plane of the front face of said panel and said metal sleeve being secured to said frame in a non-shiftable manner.

12. The form according to claim 11, wherein said frame is metallic and said metal sleeve of said bushing is welded thereto.

13. The form according to claim 11, wherein the bore of said bushing tapers outwardly in the direction opposite to said front face.

14. The form for concrete construction comprising a sheet like panel having a front face and a rear face mounted on a supporting frame, said form having a plurality of openings extending through the panel and frame perpendicularly to the front face, a bushing located in at least one of said openings, said bushing comprising a cylindrical metallic sleeve and a tubular plastic member inserted therein, said plastic member having an inner conically tapered bore, the surface of which is continuous and substantially smooth, said plastic member and said metallic sleeve having cooperating means for securing said plastic member therein, one end of said bushing lying in the plane of the front face of said panel and said metal sleeve being secured to said frame in a non-shiftable manner.

15. The form according to claim 14, wherein said frame is metallic and said metal sleeve is welded thereto.

16. The form according to claim 14, wherein said plastic member is provided with an annular bead and said metallic sleeve is formed with an annular groove cooperating with said beam to secure said plastic member therein.

17. The form according to claim 14, wherein said frame is formed with a flange extending perpendicularly to the front face of said panel, said flange being continuous about the periphery of said frame to surround the edges of said panel and having a depth substantially equal to the thickness of said panel.

* * * * *